US012092326B2

(12) United States Patent
Kimberlin

(10) Patent No.: US 12,092,326 B2
(45) Date of Patent: Sep. 17, 2024

(54) VARIABLE VANE OVERFIRE AIR NOZZLES, SYSTEM, AND STRATEGY

(71) Applicant: Tyler K C Kimberlin, Fort Collins, CO (US)

(72) Inventor: Tyler K C Kimberlin, Fort Collins, CO (US)

(73) Assignee: Tyler K C Kimberlin, Fort Collins, CO (US)

( * ) Notice: Subject to any disclaimer, the term of this patent is extended or adjusted under 35 U.S.C. 154(b) by 0 days.

(21) Appl. No.: 17/508,203

(22) Filed: Oct. 22, 2021

(65) Prior Publication Data

US 2023/0129890 A1 Apr. 27, 2023

(51) Int. Cl.
*F23M 9/02* (2006.01)
*F23L 9/00* (2006.01)

(52) U.S. Cl.
CPC *F23M 9/02* (2013.01); *F23L 9/00* (2013.01)

(58) Field of Classification Search
CPC ..... F23L 9/04; F23L 13/02; F23L 13/04
See application file for complete search history.

(56) References Cited

U.S. PATENT DOCUMENTS 1,469,375 A * 10/1923 Alsfasser ..... F23L 13/02 188/67
2,273,490 A * 2/1942 Jabelmann ..... F23L 17/16 417/155
2,320,194 A * 5/1943 Olsen ..... F23L 13/02 137/504
2,848,042 A * 8/1958 Wright ..... F23D 14/04 431/180
3,742,916 A 7/1973 Wessberg
3,943,861 A 3/1976 Astrom
4,099,471 A 7/1978 Sander
4,425,855 A 1/1984 Chadshay
4,480,558 A * 11/1984 Russell ..... F23L 3/00 110/297
4,494,004 A 1/1985 Mauer, IV et al.
4,545,308 A 10/1985 Zaterka
4,838,182 A 7/1989 Goodspeed
4,846,080 A 7/1989 Ross
5,564,632 A 10/1996 Prohazka
5,623,884 A * 4/1997 Penterson ..... F23K 3/02 239/406
5,824,275 A 10/1998 Bitzer
6,148,744 A * 11/2000 Chapman ..... F23C 5/32 110/213
6,192,810 B1 * 2/2001 Stallings ..... F23L 13/00 110/297
7,665,458 B2 2/2010 Waltz
7,681,508 B2 3/2010 Taniguchi
7,878,130 B2 2/2011 Yamamoto
2012/0137938 A1 * 6/2012 Orii ..... F23L 9/04 431/185
2012/0174837 A1 * 7/2012 Shan ..... F23L 9/04 110/313

(Continued)

*Primary Examiner* — David J Laux

(57) ABSTRACT

Nozzles for delivering air into a combustion system of a boiler utilizing an interchangeable divided nozzle barrel along with a variable vane. The vane can be rotated to different divisions in the nozzle to change the size of the outlet flow area and subsequently the flow velocity of the air into the combustion system to optimize performance and adjust for changes in load and fuel.

6 Claims, 3 Drawing Sheets

(56) References Cited

U.S. PATENT DOCUMENTS

| | | | | |
|---|---|---|---|---|
| 2015/0233579 | A1* | 8/2015 | Imig | F23D 14/46 431/189 |
| 2016/0146462 | A1* | 5/2016 | Cohen | F23C 6/045 431/9 |
| 2017/0045219 | A1* | 2/2017 | Levasseur | F23C 5/32 |
| 2019/0376687 | A1* | 12/2019 | Super | F23N 5/187 |

* cited by examiner

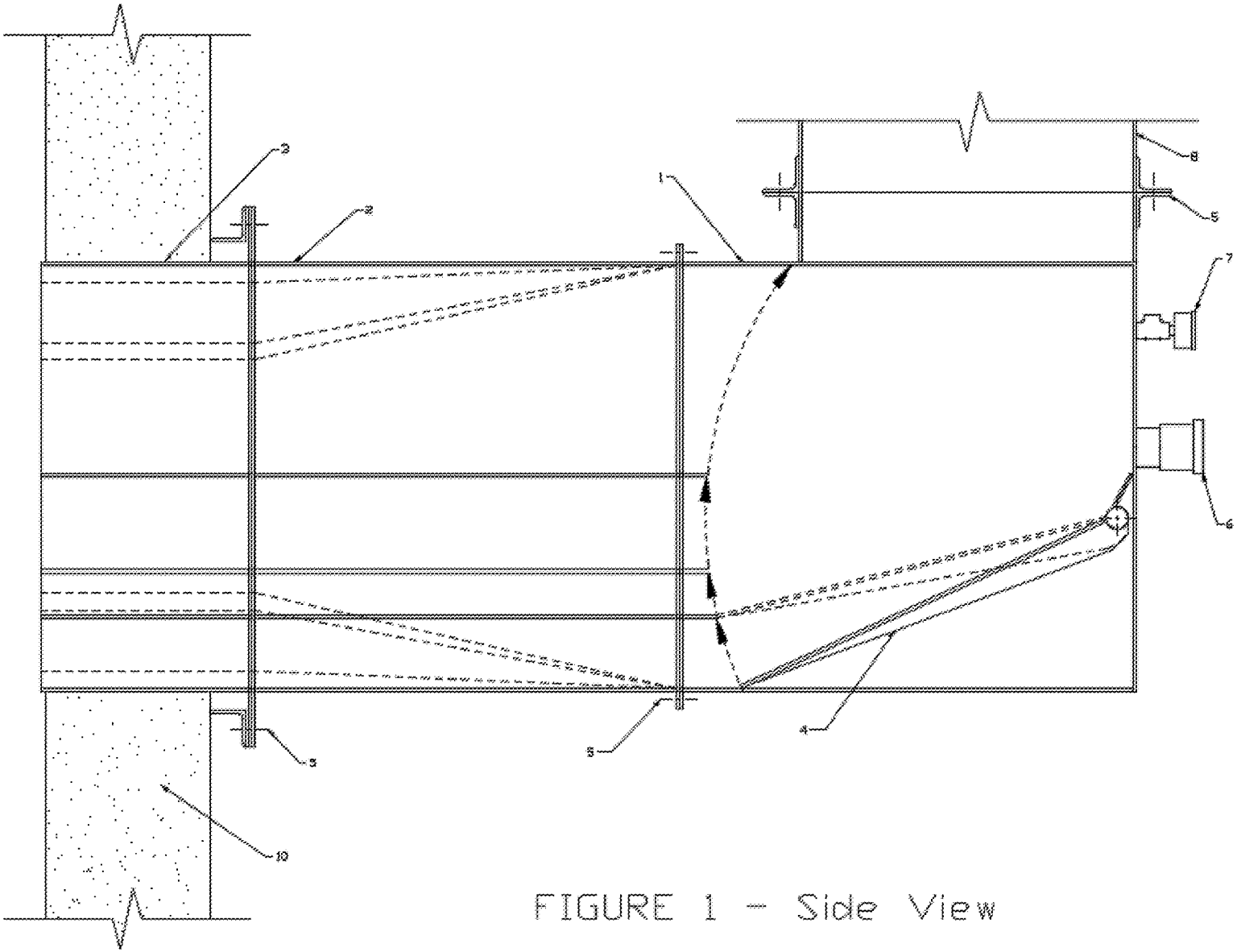
FIGURE 1 – Side View

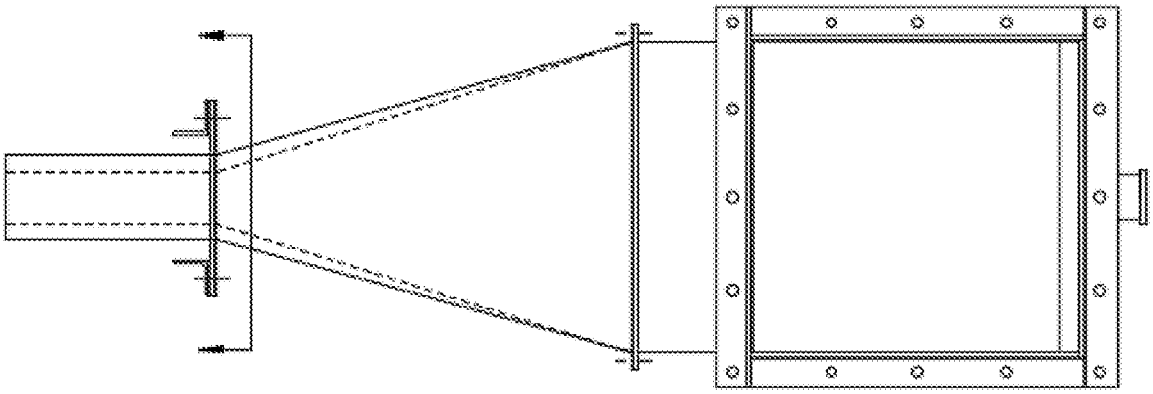
FIG. 1A - Top View
FIG. 1A - Section View
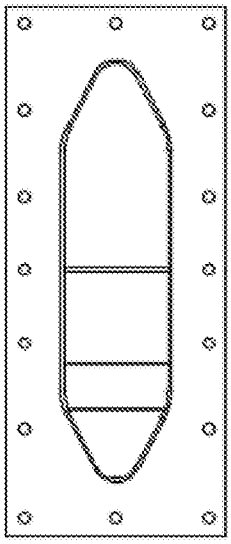

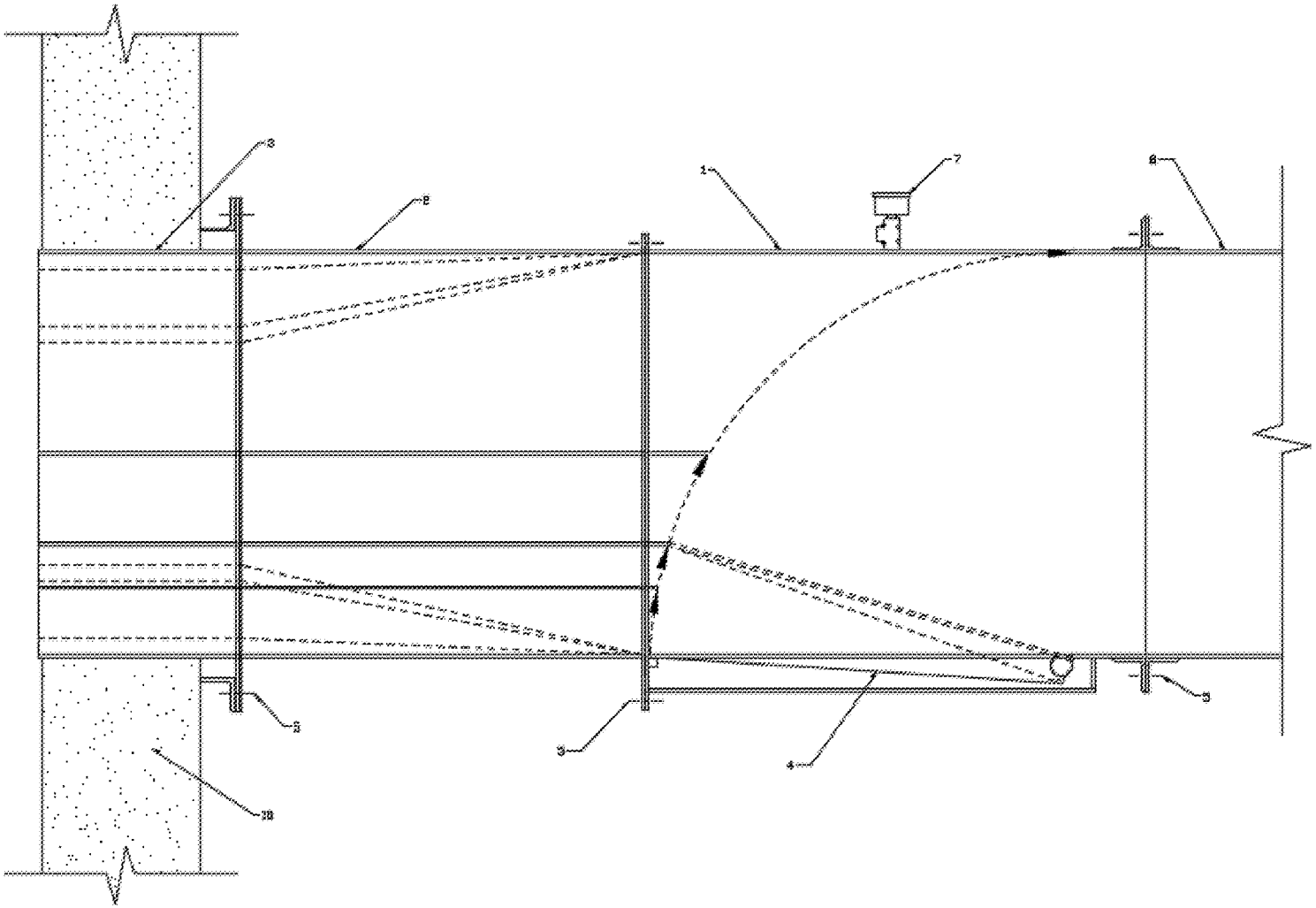
FIGURE 2 - Side View

VARIABLE VANE OVERFIRE AIR NOZZLES, SYSTEM, AND STRATEGY

TECHNICAL FIELD

The present invention, called Variable Vane Overfire Nozzles along with Optimized Overfire Air System and Strategy, herein referred to as OOA, relates typically to combustion furnaces, boilers to the delivery of combustion air into combustion systems usually found in pulp and paper mills, but also small wood and biomass furnaces, gasifiers, waste-to-energy boilers, etc. However, Variable Vane Nozzles can be used in a wide variety of applications beyond combustion systems, for example, anything used to mix two or more gases.

BACKGROUND INFORMATION

Air used for combustion that is delivered into a combustion system through multiple openings in the walls of a furnace can be done so with very simple ports like that of U.S. Pat. No. 3,742,916 or more complex nozzles which accelerate the air flow through a nozzle, like that of U.S. Pat. No. 4,940,004 and/or nozzles that can effectively change the opening size to change the air flow quantity and/or velocity.

Examples include openings that utilize "velocity dampers" like those shown in U.S. Pat. Nos. 4,099,471 and 4,480,558 and 4,838,182 and 4,846,080 and 6,192,810 B1 or various moveable obstructions like those shown in U.S. Pat. Nos. 3,943,861 and 4,545,308 and 5,564,632 and 7,681,508 B2 where the exit itself changes in size and shape and "divided nozzles" with upstream dampers that can choke or block-off portions of a divided opening as shown in U.S. Pat. Nos. 4,425,855 and 5,824,275 and 7,665,458 and 7,878,130.

An opening fitted with a velocity damper or moveable obstruction have a poor flow path which then require more pressure to overcome, and also it often negatively effects the resulting jet of air entering the furnace. These also have moving parts close to the opening, close to the high temperature and often corrosive, ash, and slag laden furnace section making them prone to plugging, seizing, failure, and/or high maintenance. Such complex designs can also be quite expensive.

An opening fitted with divisions and upstream dampers or the like usually produce a better air jet and keep moving parts away from the furnace, but they can only be controlled and/or tuned to the degree with which they're divided, the more divisions, the more costly, complex, and the larger the footprint. Often these have a better, but still a poor flow path. Having fewer divisions also require the nozzles and openings to be sized and divided very close to optimal to be effective, and all designs to date require a separate means of movement for each division.

SUMMARY DESCRIPTION

Many boilers are operated at varying loads and/or varying fuel and have a need for better combustion air control "on the fly" while others have a need for more tune-ability. To truly optimize the combustion air delivery, the size of the openings need to be adjustable so the jet velocity can be changed independently of flow, and/or concurrently. OOA systems include at least one nozzle, but almost always multiple nozzles which can be optimized by moving a vane at each nozzle which effectively changes the exit flow area of the nozzle, further on the fly tuning and control is with upstream pressure and flow regulation. Flow rate can be calculated from the vane position and pressure measured at each individual nozzle, or for multiple nozzles. The vane can be controlled manually or with just one actuator. Pressure can be measured using typical pressure gauges, transducers, transmitters, etc. Pressure, flow, and damper position control are often used in the overall tuning and control strategy of the boiler. The Variable Vane Nozzles along with the OOA Strategy and Systems can be used to optimize the location, arrangement, and especially nozzle/nozzle division sizes for one boiler then simplified for subsequent similar boilers operating at one or more facilities. The nozzles themselves also have just one moving part far from the furnace and a better flow path, often including smooth and/or curved entrances, transitions, and converging sections.

DESCRIPTION OF THE DRAWINGS

Some embodiments of the Variable Vane Overfire Air Nozzles are illustrated as examples and are not limited by the figures of the attached drawings, in which like references may indicate similar elements.

FIG. 1 depicts one Variable Vane Nozzle (usually of a multitude), fed by an overhead duct and utilizing a variable turning vane, according to one embodiment.

FIG. 2 depicts one Variable Vane Nozzle (usually of a multitude), fed from the front utilizing a flush mounted variable vane, according to one embodiment.

DETAILED DESCRIPTION OF THE VARIABLE VANE OVERFIRE AIR NOZZLES

Various embodiments and aspects of Variable Vane Nozzles will be described with reference to details discussed within this application, and the accompanying drawings will illustrate the various embodiments. The following description and drawings are illustrative of Variable Vane Nozzles and are not to be construed as limiting. Specific details are described to provide a thorough understanding of the various embodiments. However, in certain instances, well-known or conventional details are not described in order to provide a concise discussion of the embodiments of the nozzles.

The terminology used herein is for the purpose of describing particular embodiments only and is not intended to be limiting of the invention. As used herein, the term "and/or" includes any and all combinations of one or more of the associated listed items. As used here I, the singular forms of "a," "an," and "the" are intended to include the plural forms as well as the singular forms, unless the context clearly indicates otherwise. It shall be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms such as those defined in commonly used dictionaries, should be interpreted as having a meaning that is consistent with their meaning in the context of the relevant art and present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and claims.

FIGS. 1 and 2 show embodiments of the Variable Vane Nozzles as being oval in cross-section, round is ideal for the jet performance, but virtually any cross-section can be used. Both Figures show straight turning vanes and converging sections, but these would ideally be curved.

FIG. 1 shows one embodiment of a Variable Vane Nozzle being fed combustion air by an overhead duct 8. From the duct the air is transitioned from vertical to horizontal in the nozzle body 1, to a converging section 2 where the flow is accelerated, then to a nozzle barrel 3. The flow path of the transition and converging section are as smooth as practical, and the nozzle barrel sufficiently long so as to pass through the furnace skin, casing, refractory, and/or boiler tube openings 10 and to produce a good jet of air entering the furnace. There is an access port 6 adjacent to the nozzle barrel so that build-up can be removed, usually with a long rod, the port is often fitted with high temperature glass so that buildup, corrosion, and furnace conditions can be easily monitored. The nozzle has divisions running through the converging section and nozzle barrel, the vane 4 can be rotated to each division effectively changing the flow area of the overfire air nozzle.

The embodiment in FIG. 1 shows one possible method of changing or replacing nozzle barrels where the converging section is a spool piece that is first disconnected at the flanges 5 to give adequate space for the nozzle barrel to be removed. The nozzle barrel and converging section can be easily replaced and are interchangeable to different sizes/shapes, and divisions.

FIG. 2 shows one embodiment of a Variable Vane Nozzle being fed combustion air from the front. From the duct 8 the air passes through the nozzle body 1, to a converging section 2 where the flow is accelerated, then to a nozzle barrel 3. The flow path of the transition and converging section is as smooth as practical, and the nozzle barrel sufficiently long so as to pass through the furnace skin, casing, refractory, and/or boiler tube openings 10 and to produce a good jet of air entering the furnace. The access port (not shown) would be mounted to the duct. The nozzle has divisions and the vane 4 can be rotated to each division effectively changing the flow area of the overfire air nozzle. Alternatively, 2 vanes could be used and/or the vane mounted within the converging section for a smaller footprint.

The embodiment in FIG. 2 shows one possible method of changing or replacing nozzle barrels where the converging section is a spool piece that is first disconnected at the flanges 5 to give adequate space for the nozzle barrel to be removed. The nozzle barrel and converging section can be easily replaced and are interchangeable to different sizes/shapes, and divisions.

The variable vane nozzles are sometimes mounted within a plenum or an air/wind box, essentially-anything with a large open area or duct usually meant for distributing air to multiple ports or multiple areas on a furnace/boiler by which the nozzle is connected to or fits within. The Variable Vane Nozzles are depicted with manual clean-out ports, but could alternatively be fitted with removable panels and/or automatic buildup removal, port-rodders. Mounting to the boiler is usually accomplished by welding to the casing or a refractory filled box behind tube-bend openings, often with an additional support brace to the body and/or additional supports to aid in nozzle barrel replacement.

The combustion air doesn't have to be air, it can be any gas used for combustion, or a mixture of gas and air, entrained combustible particulate, etc. Small changes to the flow area of the nozzle barrel can result in large changes in combustion/boiler performance, often the interchangeable barrels are simply constructed with different wall thicknesses, for example giving a slightly smaller ID for a small change in the flow area. Varying barrel thickness can also be used for corrosion control. The connections 5 shown are simple bolted flanges, but there are many possibilities for different connection types. Likewise, the mount is a simple steel angle flange welded to the furnace casing, but the nozzle/assembly could be mounted many different ways.

Mounted upstream of the nozzle barrel is a connection 7 for a test port, pressure gauge and/or pressure transmitter that can be used for tuning, control and/or determining the rate of flow through the nozzle(s).

Often Variable Vane Nozzles will be used to determine the optimal nozzle size and/or divisions then copied for other similar boilers, but with a simpler design, not necessarily interchangeable or as replaceable and/or with fewer divisions, etc. This patent is meant to also apply to these simpler, subsequent designs when derived from Variable Vane Nozzles.

The invention claimed is:

1. A method of operating an overfire air nozzle for delivering an oxygen-containing gas into a combustion system, the method comprising:

providing an overfire air nozzle having an outlet that is over-divided into at least two outlet sections by at least one division; and operating the overfire air nozzle by blocking off one or more outlet sections of the overfire air nozzle.

2. A method of installing an overfire air nozzle for delivering an oxygen-containing gas into a combustion system, the method comprising:

providing an overfire air nozzle having a divided outlet that is over-sized or over-divided; and operating the overfire air nozzle by blocking off one or more outlet sections to determine the overfire outlet size or division size; and installing ot modifying an overfire air nozzle sized and divided as determined using the over-divided or over-sized overfire air nozzle.

3. A variable vane overfire air nozzle for delivering an oxygen-containing gas into a combustion system, the variable vane overfire air nozzle comprising:

an interchangeable nozzle barrel capable of being removed and replaced and having an outlet, wherein the outlet is divided into at least two sections by at least one division;

at least one moveable vane connected to the nozzle sidewall, wherein the at least one moveable vane is capable of selectively blocking off one or more outlet sections by aligning with the at least one division; and at least one manual lever or actuator to move the at least one movable vane.

4. The variable vane overfire air nozzle of claim 3, further comprising:

a site port for observing and/or a rod-out port for removing slag build up.

5. The variable vane overfire air nozzle of claim 3, further comprising:

a connection for a test port, pressure gage, and/or pressure transmitter.

6. A method of operating a variable vane overfire air nozzle for delivering an oxygen-containing gas into a combustion system, the method comprising:

providing a variable vane overfire air nozzle having:

an interchangeable nozzle barrel capable of being removed and replaced and having an outlet, wherein the outlet is divided into at least two outlet sections by at least one division;

at least one moveable vane connected to the nozzle sidewall, wherein the at least one moveable vane is capable of selectively blocking off one or more outlet sections by aligning with the at least one division; and at least one manual lever or actuator to move the at least one movable vane;

and operating the at least one moveable vane with the manual lever or actuator to cause the vane to align with one of the at least one divisions to block off at least one section of the the overfire air flow.

* * * * *